US008446239B2

(12) United States Patent
Niimi et al.

(10) Patent No.: US 8,446,239 B2
(45) Date of Patent: May 21, 2013

(54) ELECTROMAGNETIC SWITCH

(75) Inventors: Masami Niimi, Handa (JP); Mitsuhiro Murata, Niwa-gun (JP); Takahisa Inagaki, Nishio (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/468,559

(22) Filed: May 10, 2012

(65) Prior Publication Data

US 2012/0293284 A1 Nov. 22, 2012

(30) Foreign Application Priority Data

May 18, 2011 (JP) ..... 2011-111000

(51) Int. Cl.
*H01H 67/02* (2006.01)

(52) U.S. Cl.
USPC ..... 335/126; 335/131

(58) Field of Classification Search
USPC ..... 335/126, 131
See application file for complete search history.

(56) References Cited

U.S. PATENT DOCUMENTS

| | | | | |
|---|---|---|---|---|
| 2,831,938 | A * | 4/1958 | Moyer | 335/189 |
| 7,852,178 | B2 * | 12/2010 | Bush et al. | 335/126 |
| 8,269,585 | B2 * | 9/2012 | Choi | 335/126 |
| 2004/0032309 | A1 * | 2/2004 | Kajino et al. | 335/126 |
| 2006/0050466 | A1 * | 3/2006 | Enomoto et al. | 361/160 |

FOREIGN PATENT DOCUMENTS

JP A-2003-297207 10/2003

* cited by examiner

*Primary Examiner* — Alexander Talpalatski
(74) *Attorney, Agent, or Firm* — Oliff & Berridge, PLC

(57) ABSTRACT

An electromagnetic switch operative to close and open an electrical contact arrangement to thereby turn on and off an electrical current flowing through an electrical circuit. A movable iron core includes a shaft insertion hole that extends in an axial direction of the movable iron core and has an opening in an end face of the movable iron core axially opposing a movable contact of the electrical contact arrangement. The hole includes a step disposed at a position along the depth, a shaft fixture section on a bottom side of the step, and a shaft guide section on an opening side of the step. An inside diameter of the shaft fixture section is smaller than an inside diameter of the shaft guide section. One axial end side portion of the shaft is press fit in the shaft fixture section.

10 Claims, 5 Drawing Sheets

ELECTROMAGNETIC SWITCH

CROSS-REFERENCE TO RELATED APPLICATION

This application is based on and claims the benefit of priority from earlier Japanese Patent Application No. 2011-111000 filed May 18, 2011, the description of which is incorporated herein by reference.

BACKGROUND

1. Technical Field

This invention relates to an electromagnetic switch operative to close and open an electrical contact arrangement to thereby turn on and off an electrical current flowing through an electrical circuit.

2. Related Art

A known electromagnetic switch, as disclosed in Japanese Patent Application Publication No. 2003-297207, includes an electrical contact arrangement having a pair of fixed contacts and a movable contact, a coil that generates an electromagnetic force when energized, a movable iron core that is movable in a axial direction of the coil, and a resin shaft that transfers a movement of the movable iron core to the movable contact when the electrical contact arrangement is switched from a closed state to an open state.

When the electromagnetic switch is in an OFF state, i.e., when the coil is not in an energized state, the movable iron core is pushed back under influence of a return spring and the movable contact is pressed against an end face of the shaft secured to the movable iron core, so that the movable contact is spaced apart from the pair of fixed contacts, which leads to the open state of the electrical contact arrangement.

When the coil is energized during the open state of the electrical contact arrangement, the movable iron core is attracted into the coil and the movable contact connects or bridges the pair of fixed contacts under influence of a contact pressure spring, which leads to the closed state of the electrical contact arrangement.

In the electromagnetic switch disclosed in Japanese Patent Application Publication No. 2003-297207, as shown in FIG. 7, one axial end side portion of the shaft 120 (a distal end side portion of the shaft relative to the movable contact) is inserted into a shaft insertion hole 110 formed in the movable iron core 100. A periphery of an opening of the shaft insertion hole 110 is plastically deformed inwardly in an inside diameter direction of the hole by a punch 130 pressing against the periphery. An outer periphery of the shaft 120 is pressed against a resultant deformity (referred to as a crimping portion 140) of the movable iron core 100 so that the shaft 120 can be secured to the movable iron core.

However, since an inside diameter of the shaft insertion hole 110 is slightly larger than an outside diameter of the shaft 120, the shaft is in a clearance fit with the hole just before the deformation of the periphery of the opening, i.e., immediately after the one axial end side portion of the shaft 120 is inserted into the shaft insertion hole 110. Accordingly, there is a tendency for the shaft 120 to be secured to the movable iron core in an inclined attitude relative to a center axis of the hole after the deformation of the periphery of the opening.

When the electrical contact arrangement is switched from the closed state to the open state, i.e., when the plunger is pushed back by a reaction force of the return spring after de-energization of the coil, with the shaft 120 being secured to the movable iron core 100 in such an inclined attitude, a proximal corner of the shaft 120 relative to the movable contact first contacts the movable contact and then the entire proximal end face of the shaft 120 is brought into contact with the movable contact when the movable contact is pressed against the shaft 120 at a return position of the movable contact. This gives rise to a bending moment acting on the shaft 120. Since a load caused by the bending moment is intensively applied to the crimping portion 140, the joint between the shaft and the crimping portion 140 is likely to become loose, which may reduce securing capability for securing the shaft 120 to the movable iron core 100.

In consideration of the foregoing, exemplary embodiments of the present invention are directed to providing an electromagnetic switch that can prevent reduction in securing capability for securing a shaft to a movable iron core.

SUMMARY

In accordance with an exemplary embodiment of the present invention, there is provided an electromagnetic switch including: a coil that generates an electromagnetic force when energized: a movable iron core that is movable in a axial direction of the coil; an electrical contact arrangement including a pair of fixed contacts electrically connected to an electrical circuit, and a movable contact adapted to electrically connect and disconnect the pair of fixed contacts in response to a movement of the movable iron core; and a resin shaft that transfers the movement of the movable iron core to the movable contact when the electrical contact arrangement is switched from a closed state to an open state. The movable iron core includes a shaft insertion hole of a predetermined depth that extends in an axial direction of the movable iron core and has an opening in an end face of the movable iron core axially opposing the movable contact. The shaft insertion hole includes a step disposed at a specific position along the depth and extending in a circumferential direction of the hole. The shaft insertion hole further includes a shaft fixture section on a bottom side of the step and a shaft guide section on an opening side of the step such that an inside diameter of the shaft fixture section is smaller than an inside diameter of the shaft guide section. One axial end side portion of the shaft is press fit in the shaft fixture section so that an outer periphery of the shaft is engaged with an inner periphery of the shaft fixture section.

With this configuration, one axial end side portion of the shaft is press fit in the shaft fixture section so that the outer periphery of the shaft is engaged with the inner periphery of the shaft fixture section, which can prevent the shaft from being secured to the movable iron core in an inclined attitude relative to a center axis of the hole.

When the shaft is secured to the movable iron core in such an inclined attitude and the entire end face of the shaft is brought into contact with the movable contact, a bending moment will act on the shaft and a load caused by the bending moment will be applied on the shaft fixture section. In the conventional electromagnetic switch as disclosed in Japanese Patent Application Publication No. 2003-297207, since the load caused by the bending moment is intensively applied to the crimping portion 140, the joint between the shaft and the crimping portion 140 may become loose, which may reduce shaft securing capability.

In contrast, in the present invention, the load caused by the bending moment can be received more widely by the entire shaft fixture section. As a result, the joint between the shaft fixture section and the shaft is less likely to become loose, which can prevent reduction in shaft securing capability.

In the above electromagnetic switch of the present invention, the shaft guide section having an inside diameter larger than that of the shaft fixture section is formed on the hole-opening side, which provides advantages over embodiments where the shaft insertion hole has no shaft guide section and one axial end portion of the shaft is press fit in the entire shaft insertion hole where an axial insertion depth is a full depth of the hole.

In embodiments where the shaft is press fit in the entire shaft insertion hole without the shaft guide section, it would be difficult to align a center axis of the shaft with a center axis of the hole prior to the press fit of the shaft in the hole and it would take a longer time to finish the press fit of the shaft in the hole.

In contrast, in the present invention, the shaft can be held by the shaft guide section just before the one axial end portion of the shaft is press fit in the shaft fixture section. That is, the shaft can be held by the shaft guide section so that the center axis of the shaft can be aligned with the center axis of the shaft insertion hole prior to the press fit. This can facilitate positioning of the shaft just before the press fit, which leads to reduction in time required for the press fit.

Further, in the above electromagnetic switch of the present invention, a press fit depth (an axial depth of a portion of the hole in which the shaft is press fit) and a load required for the press fit can be reduced, as compared with the embodiments where the shaft insertion hole has no shaft guide section and one axial end portion of the shaft is press fit in the entire shaft insertion hole. This can prevent change in dimension and change in shape which would be caused by the press fit of the shaft in the shaft insertion hole.

In addition, a step is formed at a specific position along the depth of the hole in the movable iron core. Although the shaft insertion hole is a stepped hole, the shaft guide section and the shaft fixture section can be formed simultaneously by means of cold forging or a stepped blade. In other words, a step of producing the shaft guide section and a step of producing the shaft fixture section can be performed not sequentially, but simultaneously, which leads to substantially the same cost as required to produce a shaft insertion hole without the step of the hole.

Preferably, the movable iron core includes a crimping portion projecting inwardly in an inside diameter direction of the shaft insertion hole from the whole periphery of the opening of the hole, and an outer periphery of the shaft is pressed against the crimping portion. Alternatively, the movable iron core includes a plurality of crimping portions projecting inwardly in an inside diameter direction of the shaft insertion hole from a plurality of peripheral segments of the opening of the hole, and an outer periphery of the shaft is pressed against the crimping portions.

With this configuration, one axial end side portion of the shaft is press fit in the shaft fixture section and the outer periphery of the shaft is pressed against the crimping portion or portions at an intermediate position along the length of the shaft so that the shaft can be secured to the movable iron core more rigidly. Therefore, even when a bending moment caused by the entire end face of the inclined shaft being pressed against and in contact with the movable contact is acting on the shaft, a load caused by the bending moment can be received not only by the shaft fixture section, but also by the crimping portion or portions. Accordingly, the joint between the shaft and the shaft fixture section and the joint between the shaft and the crimping portion or portions are both less likely to become loose, which can prevent reduction in shaft securing capability.

Further, the crimping portion bites into the outer periphery of the shaft, which can prevent withdrawal of the shaft from the hole.

Preferably, the outer periphery of the shaft is pressed against the crimping portion or portions with a load smaller than a load applied on the one axial end side portion of the shaft press fit in the shaft fixture section.

This can reduce damage to the shaft caused by the load applied to the shaft by the crimping portion or portions. Accordingly, any kind of resin molded shaft easy to mass produce may be used as the shaft.

Preferably, the step is tapered so that an inside diameter of the shaft insertion hole decreases gradually in a direction from the shaft guide section to the shaft fixture section.

For example, in an embodiment where a step of the shaft insertion hole is not formed tapered as above, but formed orthogonal to the center axis of the shaft insertion hole, when the one axial end side portion of the shaft is inserted into the shaft guide section so that an end face of the shaft is in contact with the step of the hole, it cannot be ensured that the center axis of the shaft is aligned with the center axis of the shaft fixture section. In other words, since the end face of the shaft may be bought into contact with the step with the center axis of the shaft being shifted from the center axis of the shaft fixture section in an inside diameter direction of the hole, it is necessary to align the center axis of the shaft with the center axis of the shaft fixture section just before the press fit of the one axial end portion of the shaft in the shaft fixture section.

In contrast, when the step of the shaft insertion hole is tapered as above and an end face periphery of the shaft inserted into the shaft guide section is in contact with the tapered step prior to the press fit of the one axial end side portion of the shaft in the shaft fixture section, the center axis of the shaft is allowed to be self-aligned with the axis of the hole. As a result, it becomes possible to press fit the one axial end side portion of the shaft in the shaft fixture section with the center axis of the shaft being aligned with the center axis of the shaft fixture section immediately after insertion of the one axial end side portion of the shaft into the shaft guide section, which leads to reduction in time required to finish the press fit.

Preferably, one axial end side portion and the other axial end side portion of the shaft are symmetric about a center position along the length of the shaft.

This leads to no need for determining which axial end side portion of the shaft to be inserted into the shaft insertion hole. That is, either one of the two axial end side portions of the shaft may be inserted into the shaft insertion hole, which leads to elimination of wrong assembly and thus to enhancement of assembly efficiency.

Preferably, a gap between the inner periphery of the shaft guide section of the shaft insertion hole and the outer periphery of the shaft is filled with a resin. More preferably, the resin is a curable resin that is filled in the gap and cured after the one axial end side portion of the shaft is press fit in the shaft fixture section.

This allows a portion of the shaft within the shaft guide section to be held by the cured resin filled in the gap. Therefore, in the presence of a bending moment acting on the shaft as described above, a load caused by the bending moment can be received not only by the shaft fixture section, but also by the cured resin filled in the gap. Accordingly, at least one of the joint between the shaft and the shaft fixture section and the joint between the shaft and the crimping portion (or portions) is less likely to become loose, which can prevent reduction in shaft securing capability.

Preferably, the curable resin is a thermosetting resin.

Use of the thermosetting resin will prevent the cured resin from being softened even when the electromagnetic switch is exposed to a high-temperature atmosphere, which can prevent reduction in rigidity. As a result, at least one of the joint between the shaft and the shaft fixture section and the joint between the shaft and the crimping portion (or portions) is less likely to become loose for a long period of time, which allows the shaft securing capability to be maintained.

Preferably, the electromagnetic switch further includes: a pair of external terminals that electrically connect the electrical circuit and the pair of fixed contacts; and an insulating contact cover to which the pair of external terminals are secured, where the cover includes a contact receiving face thereinside that receives the movable contact at a return position of the movable contact when the electrical contact arrangement is in the open state. The movable contact is disposed on the opposite side of the pair of fixed contacts relative to the movable iron core. The movable contact is in contact with and pressed against the contact receiving face of the insulating contact cover when the coil is not in an energized state.

In the electromagnetic switch of the present invention, one axial end side portion of the shaft is press fit in the shaft fixture section, which can prevent the shaft from being secured to the movable iron core in an inclined attitude relative to the center axis of the movable iron core. However, when the shaft is driven in an inclined attitude relative to the center axis of the movable iron core and pushes against the movable contact at a position of the contact receiving face, a bending moment caused by the movable contact being pressed against the contact receiving face acts on the shaft.

With this configuration, even when a load caused by the bending moment is applied to the shaft, at least one of the joint between the shaft and the shaft fixture section and the joint between the shaft and the crimping portion (or portions) is less likely to become loose, which can prevent shaft securing capability.

DESCRIPTION OF SPECIFIC EMBODIMENTS

The present invention will be described more fully hereinafter with reference to the accompanying drawings. Like numbers refer to like elements throughout.

First Embodiment

An electromagnetic switch in accordance with a first embodiment of the present invention can be used for turning on and off a coil current of a starter for starting a driving engine.

Figure 1:
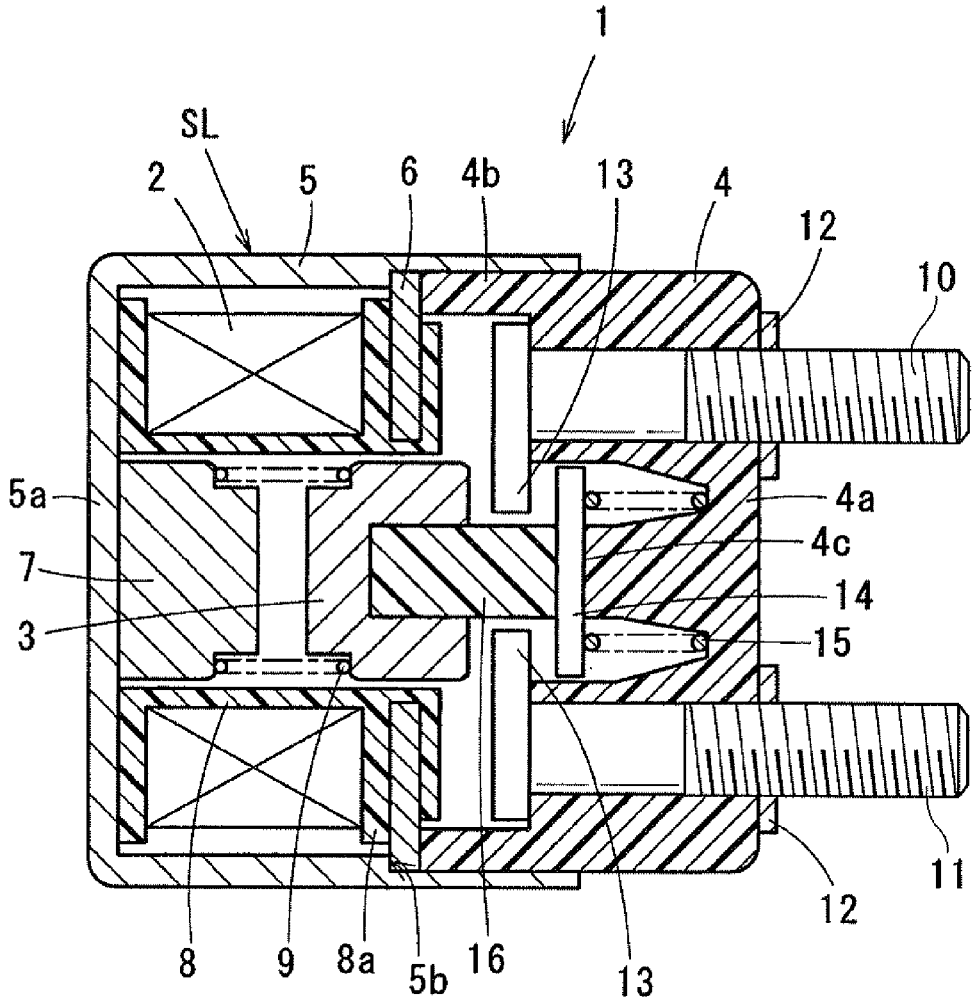
FIG. 1 is a cross sectional view of an electromagnetic switch in accordance with a first embodiment of the present invention.

There will now be explained the electromagnetic switch 1 with reference to FIG. 1.

The electromagnetic switch 1 includes a solenoid SL that includes a coil 2, which serves as an electromagnet when energized and attracts a plunger (movable iron core) 3 thereinto by an attractive force of the electromagnet, an electrical contact arrangement (which will be explained later) that opens and closes an electrical circuit of the starter, and a resin contact cover 4 that accommodates the electrical contact arrangement.

The solenoid SL includes a cup-shaped solenoid casing 5 having a bottom 5*a* at one axial end and an opening at the other axial end, the coil 2 disposed within the solenoid casing 5, an annular magnetic plate 6 disposed on the opposite side of the coil 2 to the bottom 5*a* in an axial direction of the coil 2, a fixed iron core 7 disposed on an inner periphery of the coil 2, and the plunger 3 facing the fixed iron core 7 and movable in the axial direction of the coil 2. The solenoid casing 5 also serves as a magnetic yoke that provides a magnetic passage on an outer periphery of the coil 2. The solenoid casing 5 can be produced by drawing or the like so that an inside diameter of one axial end side portion (closed-end side portion) accommodating the coil 2 therein is slightly smaller than an inside diameter of the other axial end side portion (open-end side portion) and a step 5*b* is formed between the two axial end side potions. In other words, a thickness of one axial end side portion (closed-end side portion) of the solenoid casing 5 is slightly larger than a thickness of the other axial end side portion (open-end side portion) of the solenoid casing 5, where a difference between these thicknesses provides a height of a step 5*b* formed between the two axial end side portions.

The coil 2 is wound around a resin bobbin 8. One coil end is electrically connected to a positive terminal (not shown) and the other coil end is electrically connected to a negative terminal (not shown). Both the terminals are inserted into and secured to one flange 8*a* of a bobbin 8 holding the coil 2 on a magnetic plate 6 side of the coil. End portions of the respective terminals extend in the axial direction and are disposed external to the contact cover 4. The positive terminal may be electrically connected to an electronic control unit (ECU) (not shown) via a relay or the like. The negative terminal may be connected to a ground wiring.

The magnetic plate 6 is disposed in a radial direction of the plunger 3 perpendicular to an axial direction of the plunger 3 to provide a magnetic passage between the solenoid casing 5 and the plunger 3, where the plunger 3 is movable inside the magnetic plate 6. The magnetic plate 6 is inserted into the one flange 8*a* of the bobbin 8 so as to be secured integrally thereto. In addition, a coil-side end face of the magnetic plate 6 is in contact with the step 5*b* on an inner periphery of the solenoid casing 5 so that the magnetic plate 6 can be positioned relative to the bottom 5*a* of the solenoid casing 5.

The fixed iron core 7 is made of a ferromagnetic material, such as iron that can be magnetized by the electromagnet. A distal end face of the fixed iron core 7 relative to the plunger 3 is secured in contact with the bottom 5*a* of the solenoid casing 5.

The plunger 3 is also made of a ferromagnetic material, such as iron, and is biased away from the fixed iron core 7 by the return spring 9 disposed between the fixed iron core 7 and the plunger 3. The contact cover 4 includes a closed-end portion 4*a* to which two terminal bolts (external terminals) 10, 11 are secured, and a tubular limb portion 4*b* that extends in the axial direction from an outer periphery of the closed-end portion 4*a*. The tubular limb portion 4*b* is inserted into the open-end side portion of the solenoid casing 5 through the opening so that an outer periphery of the limb portion 4*b* is engaged with an inner periphery of the open-end side portion of the solenoid casing 5 and an apical surface of the limb portion 4*b* is in contact with the a distal end face of the magnetic plate 6 relative to the coil 2, which allows the tubular limb portion 4*b* to be positioned properly in the axial direction. The open-end side portion of the solenoid casing 5 is crimped around a step (not shown) formed on the outer periphery of the limb portion 4*b* so as to be secured to the limb portion 4*b*.

The two terminal bolts 10, 11 include a battery terminal bolt 10 which may be electrically connected to a battery cable and a load terminal bolt 11 which may be electrically connected to a lead wire for an electrical load, such as a starter motor. Each of the two terminal bolts 10, 11 extends from the inside of the contact cover 4 to the outside through a through hole formed in the closed-end portion 4*a* of the contact cover 4 and secured to the contact cover 4 by means of a washer 12.

A contact space is formed inside the contact cover 4, in which space there is placed an electrical contact arrangement composed of a pair of fixed contacts 13 and a movable contact 14.

The pair of fixed contacts 13 are integral to the battery terminal bolt 10 and the load terminal bolt 11, respectively. Alternatively, the pair of fixed contacts 13 may be distinct from and secured to the battery terminal bolt 10 and the load terminal bolt 11 by press fit or welding, respectively, where the fixed contacts 13 and the terminal bolts 10, 11 may be made of dissimilar metal. For example, the fixed contacts 13 may be made of a high-electrical-conductivity copper material. The terminal bolts 10, 11 may be made of a high-mechanical-strength iron material. In addition, the terminal bolts 10, 11 made of the iron material may be plated with copper or tin, which can increase electrical conductivity.

The movable contact 14 is disposed on the opposite side of the pair of fixed contacts 13 to the plunger 3 (on the right hand side of the pair of fixed contacts 13 in FIG. 1) and is in contact with an end face of the shaft 16 secured to the plunger 3 under influence of a contact pressure spring 15. The contact pressure spring 15 is operative to apply a contact pressure to the movable contact 14 so that the movable contact 14 can bridge the pair of fixed contacts 13 when the electrical contact arrangement is in the closed state.

Since a set load of the contact pressure spring 15 is smaller than a set load of the return spring 9, the plunger 3 is biased away from the fixed iron core 7 under influence of the return spring 9 when the coil 2 is not in the energized state. This allows the movable contact 14 to be biased away from the pair of fixed contacts 13 through the shaft 16 secured to the plunger 3, as shown in FIG. 1, so that the movable contact 14 is pressed against a contact receiving face 4*c* formed inside the contact cover 4 at a return position of the movable contact 14 while the contact pressure spring 15 is compressed.

It will now be explained how to secure the shaft 16 to the plunger 3 with reference to FIGS. 2 and 3.

The plunger 3 includes an insertion blind hole 17 of a predetermined depth in the axial direction of the plunger 3 with a circular cross-section anywhere along the depth. An opening of the hole is disposed in one end face of the plunger 3 axially opposing the movable contact 14. As shown in FIG. 2, the shaft insertion hole 17 has a step 17*b* disposed at a specific position along the depth and extending in a circumferential direction of the hole, where a shaft fixture section 17*c* of the hole on a bottom side of the step 17*b* has an inside diameter smaller than an inside diameter of a shaft guide section 17*d* of the hole on an opening side of the step 17*b*.

The inside diameter of the shaft fixture section 17*c* is set slightly smaller than an outside diameter of the shaft 16 so that one axial end side portion of the shaft 16 can be press fit in the shaft fixture section 17*c*. A depth of the shaft fixture section 17*c* that is a length from a bottom of the hole to the step 17*b* is, for example, a third to a half of the full depth of the shaft insertion hole 17.

The inside diameter of the shaft guide section 17*d* is set slightly larger than the outside diameter of the shaft 16 so that the one axial end side portion of the shaft 16 can be smoothly inserted into the shaft guide section 17*d*.

Figure 2:
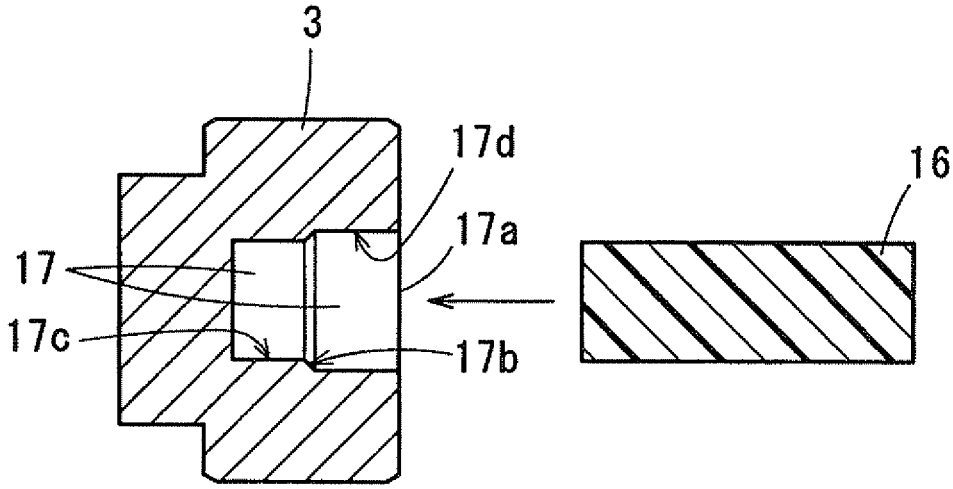
FIG. 2 is a cross sectional view of a plunger and a shaft before the shaft is secured to the plunger in accordance with the first embodiment.

As shown in FIG. 2, the step 17*b* is tapered so that the inside diameter of the shaft insertion hole 17 decreases gradually in a direction from the shaft guide section 17*d* to the shaft fixture section 17*c*.

The shaft 16 is made of a resin and produced by preparing a core material that is a rigid cotton roll and applying a pressurized phenol resin to the core material. In addition, one axial end side portion and the other axial end side portion of the shaft 16 are symmetric about a center position along the length of the shaft 16. More specifically, the shaft 16 is in the shape of a rod having a circular cross-section of a unique diameter anywhere along the length.

Figure 3:
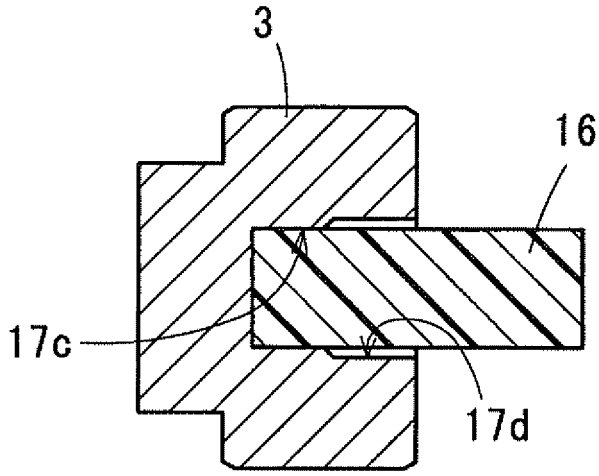
FIG. 3 is a cross sectional view of the plunger and the shaft secured to the plunger in accordance with the first embodiment.

As shown in FIG. 3, the shaft 16 is secured to the plunger 3 by press fit of the one axial end side portion of the shaft 16 in the shaft fixture section 17*c* so that an outer periphery of the shaft 16 is engaged with an inner periphery of the shaft fixture section 17*c*.

Advantages

In the electromagnetic switch 1 of the first embodiment, one axial end side portion of the shaft 16 is press fit in the shaft fixture section 17*c* so that the outer periphery of the shaft 16 is engaged with the inner periphery of the shaft fixture section 17*c*, which can prevent the shaft 16 from being secured to the plunger 3 in an inclined attitude relative to a center axis of the hole. In addition, the shaft fixture section 17*c* has a predetermined depth such that, for example, even when a bending moment caused by the entire end face of the inclined shaft 16 being pressed against and in contact with the movable contact 14 is acting on the shaft 16, a load caused by the bending moment can be received more widely by the entire shaft fixture section. As a result, the joint between the shaft fixture section 17*c* and the shaft 16 is less likely to become loose, which can prevent reduction in shaft securing capability.

The shaft 16 is in the shape of a rod having a circular cross-section of a unique diameter anywhere along the length and the shaft 16 is symmetric about a center position along the length, which leads to no need for determining which axial end side portion of the shaft 16 to be inserted into the shaft insertion hole 17. That is, either one of the two axial end portions of the shaft 16 may be inserted into the shaft insertion hole 17, which leads to elimination of wrong assembly and thus to enhancement of assembly efficiency.

Further, in the first embodiment, the inside diameter of the shaft guide section 17*d* of the shaft insertion hole 17, which is an opening side section of the hole, is slightly larger than the outside diameter of the shaft 16, which leads to the following advantages over embodiments where the shaft is press fit in the entire shaft insertion hole without such a shaft guide section.

In embodiments where the shaft is press fit in the entire shaft insertion hole without the shaft guide section, it would be difficult to align a center axis of the shaft with a center axis of the shaft insertion hole prior to the press fit for the shaft so as not to be secured to the plunger in an inclined attitude relative to the center axis of the hole, and it would therefore take a longer time to finish the press fit of the shaft in the hole.

In contrast, in the first embodiment, the shaft guide section 17*d* is formed on the opening side of the step 17*b*, which allows the shaft 16 to be held by the shaft guide section 17*d* prior to the press fit of one axial end side portion of the shaft 16 in the shaft fixture section 17*c*. In addition, the step 17*b* of the shaft insertion hole 17 is tapered and an end face periphery of the shaft 16 inserted into the shaft guide section 17*d* is brought into contact with the tapered step 17*b* prior to the press fit of the shaft 16 in the shaft fixture section 17*c*, which allows the center axis of the shaft 16 to be self-aligned with the center axis of the hole. As a result, it becomes possible to press fit the one axial end side portion of the shaft in the shaft fixture section 17*c* with the center axis of the shaft 16 being aligned with the center axis of the shaft fixture section 17*c* immediately after insertion of the one axial end side portion of the shaft 16 into the shaft guide section 17*d*, which leads to reduction in time required to finish the press fit.

A press fit depth (a depth of a hole section in which the shaft 16 is press fit) and a load required for the press fit can be reduced, as compared with the embodiments where the shaft is press fit in the shaft insertion hole without the shaft guide section. This can prevent change in dimension and change in shape of the shaft 16 that could be caused by the press fit of the shaft 16 in the shaft insertion hole 17.

Although the shaft insertion hole 17 formed in the plunger 3 is a stepped hole that has the step 17*b* disposed at a specific position along the depth of the hole, the shaft guide section 17*d* and the shaft fixture section 17*c* can be produced simultaneously by means of cold forging or a stepped blade. In other words, a step of producing the shaft guide section 17*d* and a step of producing the shaft fixture section 17*c* can be performed not sequentially, but simultaneously, which leads to substantially the same cost as required to produce a shaft insertion hole without the step 17*b*.

Second Embodiment

There will now be explained an electromagnetic switch 1 in accordance with a second embodiment of the present invention.

Figure 4:
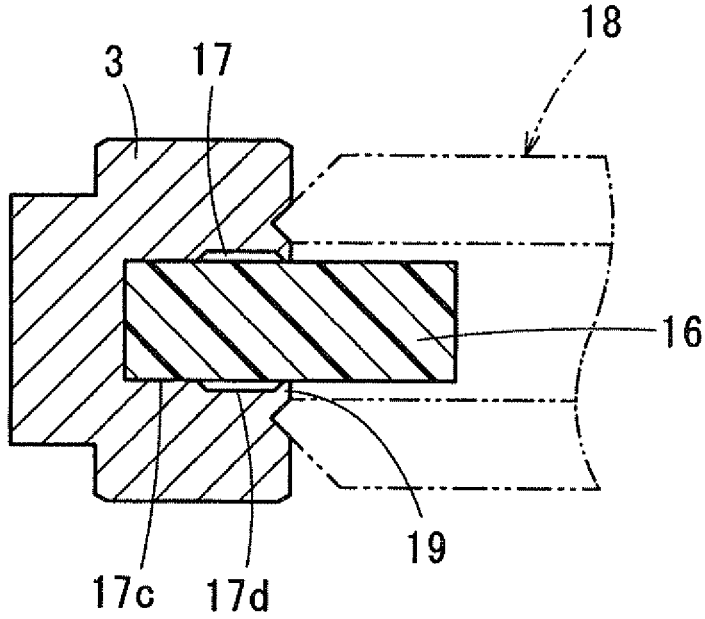
FIG. 4 is a cross sectional view of a plunger and a shaft secured to the plunger in accordance with a second embodiment of the present invention.

Additionally to the first embodiment, after one axial end side portion of the shaft 16 is press fit in the shaft fixture section 17*c* so that the outer periphery of the shaft 16 is engaged with the inner periphery of the shaft fixture section 17*c*, a periphery of the opening 17*a* in the end face of the plunger 3 is pressed against a punch 18, so that the periphery of the opening 17*a* is plastically deformed inwardly in an inside diameter direction or a radial direction of the hole and the outer periphery of the shaft 16 is pressed against a deformity (referred here to as a crimping portion 19), as shown in FIG. 4.

The punch 18 may be a non-split-type punch that can press against the whole periphery of the opening 17*a* or a split-type punch that can press against three or four (more generally, a plurality of) peripheral sections of the opening 17*a* that are, preferably, equally spaced apart from each other along the periphery of the opening 17*a*. In the case of the non-split-type punch, the resultant crimping portion 19 projects inwardly in the inside diameter direction of the shaft insertion hole 17 from the whole periphery of the opening 17*a* of the hole 17. In the case of the split-type punch, the resultant crimping portion 19 projects inwardly in the inside diameter direction of the shaft insertion hole 17 from the three or four (more generally, the plurality of) peripheral sections of the opening 17*a* of the hole 17.

With this configuration, one axial end side portion of the shaft 16 is press fit in the shaft fixture section 17*c* and the outer periphery of the shaft 16 is pressed against the crimping portion 19 at an intermediate position along the length of the shaft 16 so that the shaft can be secured to the plunger 13 rigidly. Therefore, even when a bending moment caused by the entire end face of the inclined shaft 16 being pressed against and in contact with the movable contact 14 is acting on the shaft 16, a load caused by the bending moment can be received not only by the shaft fixture section 17*c*, but also by the crimping portion 19. Accordingly, the joint between the shaft fixture section 17*c* and the shaft 16 and the joint between the crimping portion 19 and the shaft 16 are less likely to become loose, which can prevent reduction in shaft securing capability more reliably.

Figure 5:
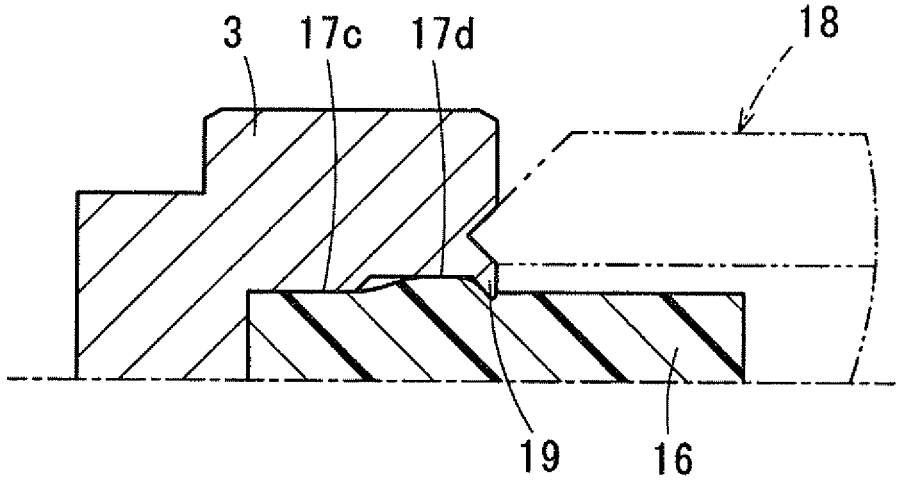
FIG. 5 is an enlarged cross sectional view of the plunger and the shaft of FIG. 4.

When the one axial end side portion of the shaft 16 is press fit in the shaft fixture section 17*c*, a portion of the shaft 16 within the shaft guide section 17*d* may be deformed outwardly in the inside diameter direction of the hole 17 with the outer periphery of the shaft being pressed against the crimping portion 19, as shown in FIG. 5. The outer periphery of the shaft 16 may be brought into contact with the inner periphery of the shaft guide section 17*d*. Accordingly, in the present embodiment, the crimping portion 19 can also serve as a stopper that can prevent withdrawal of the shaft 16 from the hole. Therefore, the shaft 16 can be secured to the plunger 3 more rigidly by the crimping portion 19 pressing against the outer periphery of the shaft, as compared with the first embodiment.

The outer periphery of the shaft 16 is pressed against the crimping portion 19 with a force or a load smaller than a load applied on the one axial end side portion of the shaft 16 press fit into the shaft fixture section 17*c*, which can reduce damage to the shaft 16 caused by the load applied to the shaft 16 by the crimping portion 19. Accordingly, the shaft 16 is not limited to the above shaft produced by preparing a core material that is a rigid cotton roll and applying a pressurized phenol resin to the core material, but any kind of resin molded shaft that is easy to mass produce may be used as the shaft 16.

Third and Fourth Embodiments

There will now be explained an electromagnetic switch 1 in accordance with a third embodiment of the present invention.

Figure 6A:
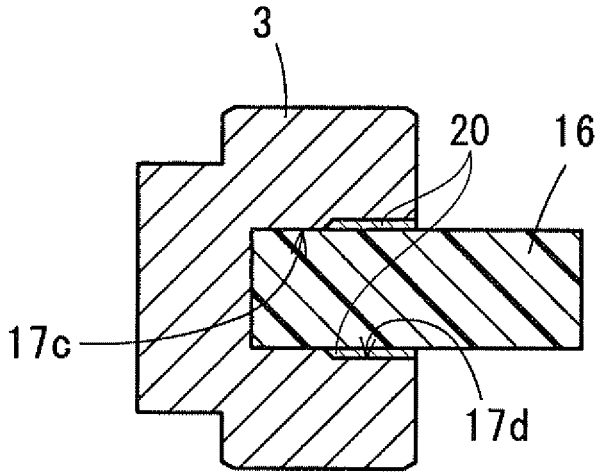
FIG. 6A is a cross sectional view of a plunger and a shaft secured to the plunger in accordance with a third embodiment of the present invention.

In the third embodiment, additionally to the first embodiment, a gap between the inner periphery of the shaft guide section 17*d* of the shaft insertion hole 17 and the outer periphery of the shaft 16 is filled with a curable resin 20 (e.g., a thermosetting resin) that is cured after the press fit and filling, as shown in FIG. 6A. The cured resin filled in the gap can hold a portion of the shaft 16 within the shaft guide section 17*d*. Therefore, in the presence of a bending moment acting on the shaft 16 as described above, a load caused by the bending moment can be received not only by the shaft fixture section 17*c*, but also by the cured resin filled in the gap. Accordingly, the joint between the shaft fixture section 17*c* and the shaft 16 is less likely to become loose, which can prevent reduction in shaft securing capability more reliably.

Figure 6B:
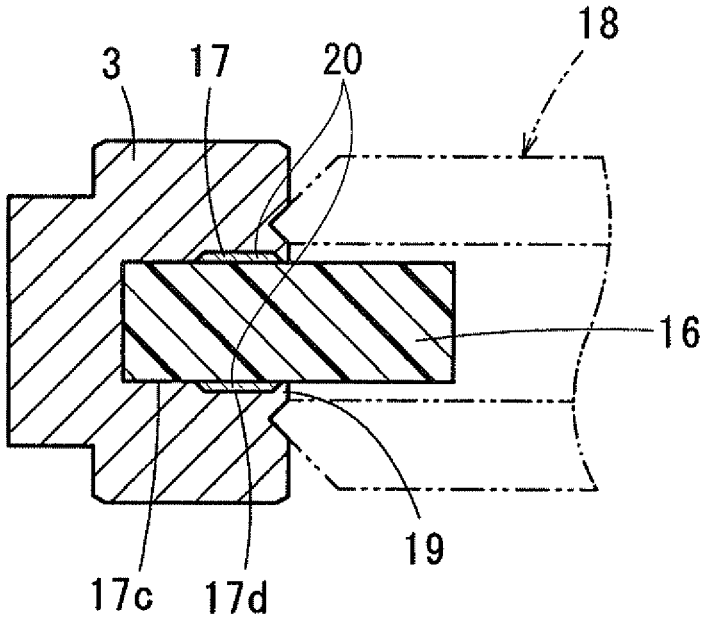
FIG. 6B is a cross sectional view of a plunger and a shaft secured to the plunger in accordance with a fourth embodiment of the present invention.
Figure 7:
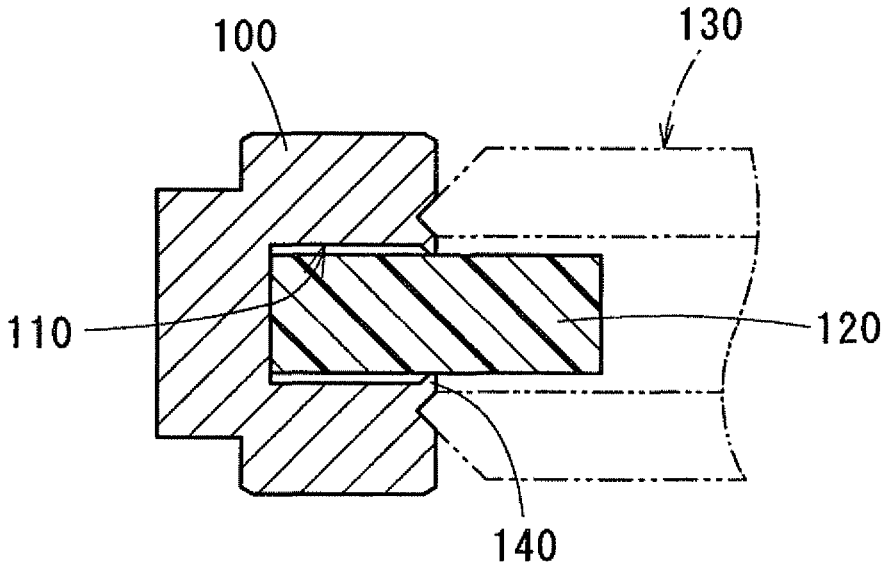
FIG.7 (PRIOR ART)
FIG. 7 is a cross sectional view of a plunger and a shaft secured to the plunger in a conventional electromagnetic switch.

In a fourth embodiment alternative to the third embodiment, additionally to the second embodiment and similarly to the third embodiment, a gap between the inner periphery of the shaft guide section 17*d* of the shaft insertion hole 17 and the outer periphery of the shaft 16 is filled with a curable resin 20 that is cured after the press fit and filling, as shown in FIG. 6B. Also in the fourth embodiment, in the presence of a bending moment acting on the shaft 16 as described above, a load caused by the bending moment can be received not only by the shaft fixture section 17*c* and the crimping portion 19, but also by the cured resin filled in the gap. The joint between the shaft fixture section 17*c* and the shaft 16 and the joint between the crimping portion 19 and the shaft 16 are less likely to become loose, which can prevent reduction in shaft securing capability more reliably.

Use of the thermosetting resin will prevent the cured resin from being softened even when the electromagnetic switch 1 is exposed to a high-temperature atmosphere, which can prevent reduction in rigidity. As a result, the joint between the shaft 16 and the hole 17 is less likely to become loose for a long period of time, which allows the shaft securing capability to be maintained.

Modifications

In the first embodiment, the electromagnetic switch 1 is of normally-open type, where when the coil 2 is not in the energized state the movable contact 14 is spaced apart from the pair of fixed contacts 13, that is, the electrical contact arrangement is opened. Alternatively, the electromagnetic switch 1 may be of normally-closed type, where when the coil 2 is not in the energized state the movable contact 14 is in contact with or bridges the pair of fixed contacts 13, that is, the electrical contact arrangement is closed.

In the first embodiment, it is assumed that the electromagnetic switch 1 is used for the electrical circuit of the starter. The present invention is applicable to various types of electromagnetic switches that turn on and off an electric current following through an electrical circuit by closing and opening the electrical contact arrangement.

In addition, in the first embodiment, the shaft 16 is in the shape of a rod having a circular cross-section with a unique diameter anywhere along the length of the shaft 16. Alternatively, the shaft 16 may be in the shape of a rod having a polygonal cross section along the length of the shaft 16, where the hole 17 also has a polygonal cross section along its depth so that the shaft 16 can be inserted and press fit in the hole.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An electromagnetic switch comprising:

a coil that generates an electromagnetic force when energized:

a movable iron core that is movable in an axial direction of the coil;

an electrical contact arrangement including a pair of fixed contacts electrically connected to an electrical circuit, and a movable contact adapted to electrically connect and disconnect the pair of fixed contacts in response to a movement of the movable iron core; and a resin shaft that transfers the movement of the movable iron core to the movable contact when the electrical contact arrangement is switched from a closed state to an open state, wherein the movable iron core includes a shaft insertion hole of a predetermined depth that extends in an axial direction of the movable iron core and has an opening in an end face of the movable iron core axially opposing the movable contact, the shaft insertion hole includes a step disposed at a specific position along the depth and extending in a circumferential direction of the hole, the shaft insertion hole further includes a shaft fixture section on a bottom side of the step and a shaft guide section on an opening side of the step such that an inside diameter of the shaft fixture section is smaller than an inside diameter of the shaft guide section, one axial end side portion of the shaft is press fit in the shaft fixture section so that an outer periphery of the shaft is engaged with an inner periphery of the shaft fixture section, the movable iron core includes a crimping portion projecting inwardly in an inside diameter direction of the shaft insertion hole from the whole periphery of the opening of the hole, and an outer periphery of the shaft is pressed against the crimping portion.

2. An electromagnetic switch comprising:

a coil that generates an electromagnetic force when energized:

a movable iron core that is movable in an axial direction of the coil;

an electrical contact arrangement including a pair of fixed contacts electrically connected to an electrical circuit, and a movable contact adapted to electrically connect and disconnect the pair of fixed contacts in response to a movement of the movable iron core; and a resin shaft that transfers the movement of the movable iron core to the movable contact when the electrical contact arrangement is switched from a closed state to an open state, wherein the movable iron core includes a shaft insertion hole of a predetermined depth that extends in an axial direction of the movable iron core and has an opening in an end face of the movable iron core axially opposing the movable contact, the shaft insertion hole includes a step disposed at a specific position along the depth and extending in a circumferential direction of the hole, the shaft insertion hole further includes a shaft fixture section on a bottom side of the step and a shaft guide section on an opening side of the step such that an inside diameter of the shaft fixture section is smaller than an inside diameter of the shaft guide section one axial end side portion of the shaft is press fit in the shaft fixture section so that an outer periphery of the shaft is engaged with an inner periphery of the shaft fixture section, the movable iron core includes a plurality of crimping portions projecting inwardly in an inside diameter direction of the shaft insertion hole from a plurality of peripheral segments of the opening of the hole, and an outer periphery of the shaft is pressed against the crimping portions.

3. The electromagnetic switch of claim 1, wherein the outer periphery of the shaft is pressed against the crimping portion with a load smaller than a load applied on the one axial end side portion of the shaft press fit in the shaft fixture section.

4. The electromagnetic switch of claim 2, wherein the outer periphery of the shaft is pressed against the crimping portions with a load smaller than a load applied on the one axial end side portion of the shaft press fit in the shaft fixture section.

5. An electromagnetic switch comprising:

a coil that generates an electromagnetic force when energized:

a movable iron core that is movable in an axial direction of the coil;

an electrical contact arrangement including a pair of fixed contacts electrically connected to an electrical circuit, and a movable contact adapted to electrically connect and disconnect the pair of fixed contacts in response to a movement of the movable iron core; and a resin shaft that transfers the movement of the movable iron core to the movable contact when the electrical contact arrangement is switched from a closed state to an open state, wherein the movable iron core includes a shaft insertion hole of a predetermined depth that extends in an axial direction of the movable iron core and has an opening in an end face of the movable iron core axially opposing the movable contact, the shaft insertion hole includes a step disposed at a specific position along the depth and extending in a circumferential direction of the hole, the shaft insertion hole further includes a shaft fixture section on a bottom side of the step and a shaft guide section on an opening side of the step such that an inside diameter of the shaft fixture section is smaller than an inside diameter of the shaft guide section, one axial end side portion of the shaft is press fit in the shaft fixture section so that an outer periphery of the shaft is engaged with an inner periphery of the shaft fixture section, and the step is tapered so that an inside diameter of the shaft insertion hole decreases gradually in a direction from the shaft guide section to the shaft fixture section.

6. An electromagnetic switch comprising:

a coil that generates an electromagnetic force when energized;

a movable iron core that is movable in an axial direction of the coil;

an electrical contact arrangement including a pair of fixed contacts electrically connected to an electrical circuit, and a movable contact adapted to electrically connect and disconnect the pair of fixed contacts in response to a movement of the movable iron core; and a resin shaft that transfers the movement of the movable iron core to the movable contact when the electrical contact arrangement is switched from a closed state to an open state, wherein the movable iron core includes a shaft insertion hole of a predetermined depth that extends in an axial direction of the movable iron core and has an opening in an end face of the movable iron core axially opposing the movable contact, the shaft insertion hole includes a step disposed at a specific position along the depth and extending in a circumferential direction of the hole, the shaft insertion hole further includes a shaft fixture section on a bottom side of the step and a shaft guide section on an opening side of the step such that an inside diameter of the shaft fixture section is smaller than an inside diameter of the shaft guide section, one axial end side portion of the shaft is press fit in the shaft fixture section so that an outer periphery of the shaft is engaged with an inner periphery of the shaft fixture section, and a gap between an inner periphery of the shaft guide section of the shaft insertion hole and the outer periphery of the shaft is filled with a resin.

7. The electromagnetic switch of claim 6, wherein the resin is a curable resin that is filled in the gap and cured after the one axial end side portion of the shaft is press fit in the shaft fixture section.

8. The electromagnetic switch of claim 7, wherein the curable resin is a thermosetting resin.

9. An electromagnetic switch comprising:

a coil that generates an electromagnetic force when energized;

a movable iron core that is movable in an axial direction of the coil;

an electrical contact arrangement including a pair of fixed contacts electrically connected to an electrical circuit, and a movable contact adapted to electrically connect and disconnect the pair of fixed contacts in response to a movement of the movable iron core; and a resin shaft that transfers the movement of the movable iron core to the movable contact when the electrical contact arrangement is switched from a closed state to an open state, wherein the movable iron core includes a shaft insertion hole of a predetermined depth that extends in an axial direction of the movable iron core and has an opening in an end face of the movable iron core axially opposing the movable contact, the shaft insertion hole includes a step disposed at a specific position along the depth and extending in a circumferential direction of the hole, the shaft insertion hole further includes a shaft fixture section on a bottom side of the step and a shaft guide section on an opening side of the step such that an inside diameter of the shaft fixture section is smaller than an inside diameter of the shaft guide section one axial end side portion of the shaft is press fit in the shaft fixture section so that an outer periphery of the shaft is engaged with an inner periphery of the shaft fixture section, the apparatus further comprises:

a pair of external terminals that electrically connect the electrical circuit and the pair of fixed contacts; and an insulating contact cover to which the pair of external terminals are secured, the cover including a contact receiving face thereinside adapted to receive the movable contact at a return position of the movable contact when the electrical contact arrangement is in the open state, wherein the movable contact is disposed on the opposite side of the pair of fixed contacts relative to the movable iron core, and the movable contact is in contact with and pressed against the contact receiving face of the insulating contact cover when the coil is not in an energized state.

10. The electromagnetic switch of claim 5, wherein the step is tapered between the shaft guide section and the shaft fixture section so that the inside diameter of the shaft insertion hole linearly decreases with depth of the shaft insertion hole from the inside diameter of the shaft guide section to the inside diameter of the shaft fixture section.

* * * * *